United States Patent [19]

Duez

[11] Patent Number: 5,027,921

[45] Date of Patent: Jul. 2, 1991

[54] METHOD AND DEVICE FOR TRANSPORTING AND DISTRIBUTING MATERIALS AND/OR EQUIPMENT AROUND THE PERIPHERY OF A BUILDING

[76] Inventor: Alain Duez, "La Treille" Salignac, 04290 Volonne, France

[21] Appl. No.: 459,807

[22] PCT Filed: May 11, 1988

[86] PCT No.: PCT/FR88/00230

§ 371 Date: Jan. 4, 1990

§ 102(e) Date: Jan. 4, 1990

[87] PCT Pub. No.: WO88/08909

PCT Pub. Date: Nov. 17, 1988

[30] Foreign Application Priority Data

May 12, 1987 [FR] France ..... 87 06757

[51] Int. Cl.[5] ..... E04G 3/16; E04G 21/00

[52] U.S. Cl. ..... 182/12; 182/37; 182/38

[58] Field of Search ..... 182/36, 37, 38, 12, 182/13, 187

[56] References Cited

U.S. PATENT DOCUMENTS

| | | | |
|---|---|---|---|
| 654,780 | 7/1900 | Burchill | 182/38 |
| 1,086,329 | 2/1914 | Liess | 182/38 |
| 1,423,998 | 7/1922 | Camp | 182/38 |
| 2,405,259 | 8/1946 | Lamb | 182/38 |
| 2,543,348 | 2/1951 | Briese | 182/37 |
| 2,730,411 | 1/1956 | Krane | 182/38 |
| 3,124,213 | 3/1964 | Jorsey | 182/38 |
| 4,300,657 | 11/1981 | Thompson . | |
| 4,773,504 | 9/1988 | Reed | 182/38 |
| 4,809,814 | 3/1989 | St-Germain | 182/146 |

FOREIGN PATENT DOCUMENTS

| | | |
|---|---|---|
| 3505174 | 8/1986 | Fed. Rep. of Germany . |
| 760884 | 3/1934 | France . |
| 771182 | 10/1934 | France . |
| 391217 | 2/1977 | Sweden . |

OTHER PUBLICATIONS

International Search Report.
International Preliminary Examination Report.

*Primary Examiner*—Reinaldo P. Machado
*Attorney, Agent, or Firm*—Sandler, Greenblum & Bernstein

[57] ABSTRACT

Device and method for transporting and distributing materials and/or equipment at the periphery of a building by using a carrier structure similar to a scaffolding or to a working or circulation walkway filled with a parapet including a carriage having at least one sliding or rolling member connecting the carriage to at least one longitudinal solid element of the parapet said connection transmitting to the parapet at least the resulting efforts equivalent to the horizontal component of the force diagram of a device.

15 Claims, 3 Drawing Sheets

METHOD AND DEVICE FOR TRANSPORTING AND DISTRIBUTING MATERIALS AND/OR EQUIPMENT AROUND THE PERIPHERY OF A BUILDING

BACKGROUND OF THE INVENTION

1. Field of the Invention

The present invention relates to a method and a device for transporting and distributing materials and/or equipment around the periphery of a building.

The invention can be used in the technical field of building construction or renovation works or civil engineering works.

It also relates to a device supplementing equipment which is widely used by builders, i.e. the various types of scaffolding and platforms used for external building works.

2. Description of Background and Material Information

The distribution of various equipment and/or materials around the periphery of a building so that external works can be carried out takes place from the ground using either cranes or mobile elevating machines, or even manually on the working platform or the flooring of the scaffolding.

Cranes provide access to all points of the building exterior, but the costs of using them to carry out external works is very high. In addition, the crane driver's lack of visibility of the external walls opposite the crane is a serious source of danger. As a result of these drawbacks, cranes are hardly ever used to carry out external works.

Mobile elevating machines have a limited working height and allow a satisfactory distribution of equipment and materials only if these machines can circulate around the entire periphery of the buildings, which is seldom the case in practice.

Finally, manual movement on working platforms is difficult and costly. The fatigue caused by such work can be reduced by trucks moving on the floor of the platform since this rolling equipment is inexpensive and easy to move. This method is not or is little used, however, since the space which the trucks occupy impedes movement on the platforms and work itself. The center of gravity of the loads also has to be low if these trucks are to be stable. Loads must therefore be low and wider than they are high.

SUMMARY OF THE INVENTION

The invention aims in particular to remedy these various drawbacks.

According to the method and device of the invention, at least one truck is attached to the parapet of the platform by creating a rigid and sliding or rolling connection therebetween. The truck is therefore always held and guided, during its movements, by the parapet. The connection is provided by at least one sliding or rolling member rigid with the truck and in engagement with at least one longitudinal member of the parapet, preferably the uppermost longitudinal member of the parapet. In addition, the truck-parapet connection makes it possible to transmit at least the horizontal forces in the force diagram of the device to the parapet.

In an embodiment, the chassis of the truck sits astride the parapet and the framework is provided with at least one wheel transmitting the weight of the truck and its load to at least one longitudinal member of the parapet framework.

In a further embodiment, the weight of the truck and its load are transmitted to the framework of the floor of the platform or scaffolding, via the rolling or sliding of the lower portion of the truck on this floor. In this case, the body of the truck may be outside or inside the parapet or straddling the latter.

In all cases, the device provides the truck with all or part of the stability needed for the free positioning of the load which it is transporting. The use of the truck guided by the parapet therefore enables, without additional cost, the transportation of loads above or externally to the parapet without impeding movement and work on the floor. The guiding provided also means that the loads can be readily manually moved simply by pushing. It can also be seen that the truck movements may be readily motor driven.

The installation of the device of the invention on a self-raising scaffolding creates a distribution system which, as a result of the coordinated movements of the truck and the platform, covers the whole of the exterior of the building. The movements of the self-raising scaffolding may also be motor driven.

Depending on the type of transport to be carried out, the truck can be provided with a container having a shape appropriate to the loads which it is to transport, which container can be provided with a tip unloading device or the like whose movements or operation may be motor driven.

In a first advantageous development of the invention, the mobile truck is provided with a lifting apparatus, for instance a cable winch, in order to lift a load from the ground and bring it to the truck; this action may be motor driven.

If the device described above is supplemented by a lifting apparatus, if each device is motor driven and if all the movements are automated in a coordinated way, a overall automatic supply plant is obtained making it possible, to pick up loads from any point on the ground around the periphery of the building in order to raise them and put them down at any point on the building facade.

According to a further advantageous development of the device of the invention, the truck may be fitted with at least one device adapted to carry out works on the facades of buildings or in the vicinity of these facades in the case of buildings being constructed or renovated. The automatic displacement and guiding of the truck may be used to form a supplement indispensable to the full automation of some machines, for instance machines adapted to carry out; paint or plaster spraying, surfacing, the laying of plates, etc.

BRIEF DESCRIPTION OF THE DRAWINGS

The above-mentioned and further objects, features and advantages will be set out in the following description and in the attached drawings in which.

DESCRIPTION OF THE PREFERRED EMBODIMENTS

Reference is made to the drawings to describe advantageous, although non limiting, examples of the method and embodiments of the device of the invention.

This method is chiefly remarkable in that at least one truck 1 is attached to the parapet 3 of the working or movement platform 4, by creating a solid and rolling or sliding connection therebetween.

Figure 1:
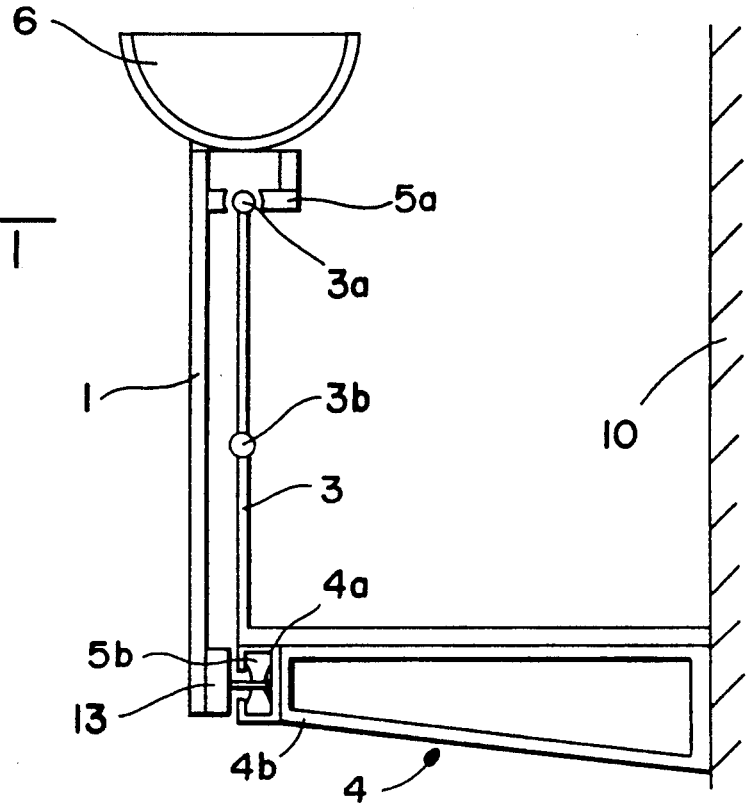
FIG. 1 is a cross-section through a truck rolling on the bearing framework of a platform, externally thereto, while being principally guided and stabilized by the parapet of this platform.

FIG. 1 shows a first embodiment of the device of the invention which comprises, in this case, a truck 1 whose lower portion is provided with one or several wheels **5*b* bearing on a longitudinal rolling and guide track 4*a* rigid with the reinforcing members 4*b* of the platform 4 formed by brackets fastened to the facade of the building, the rolling track 4*a* being disposed on the outside of these members below the parapet 3** of the platform.

In its upper portion, the truck 1 has a slide **5*a*** clamping the upper head rail of the parapet and mounted so that it can slide along the latter.

At the top, the truck 1 bears a container 6 which is formed in this case by a simple bucket.

The wheel **5*b*, or one of the wheels 5*b* when the truck is provided with a plurality of wheels, is coupled to a motor 13** so that it can be driven in rotation and the drive of the movements of the truck long the parapet.

In this embodiment, the vertical forces of the truck and its load are transmitted via the wheel(s) **5*b* to the members 4*a*, 4*b* of the reinforcement of the platform 4**, the longitudinal profiles forming the outer surface of the platform having an appropriate shape allowing the introduction and movement of the wheels.

Figure 2:
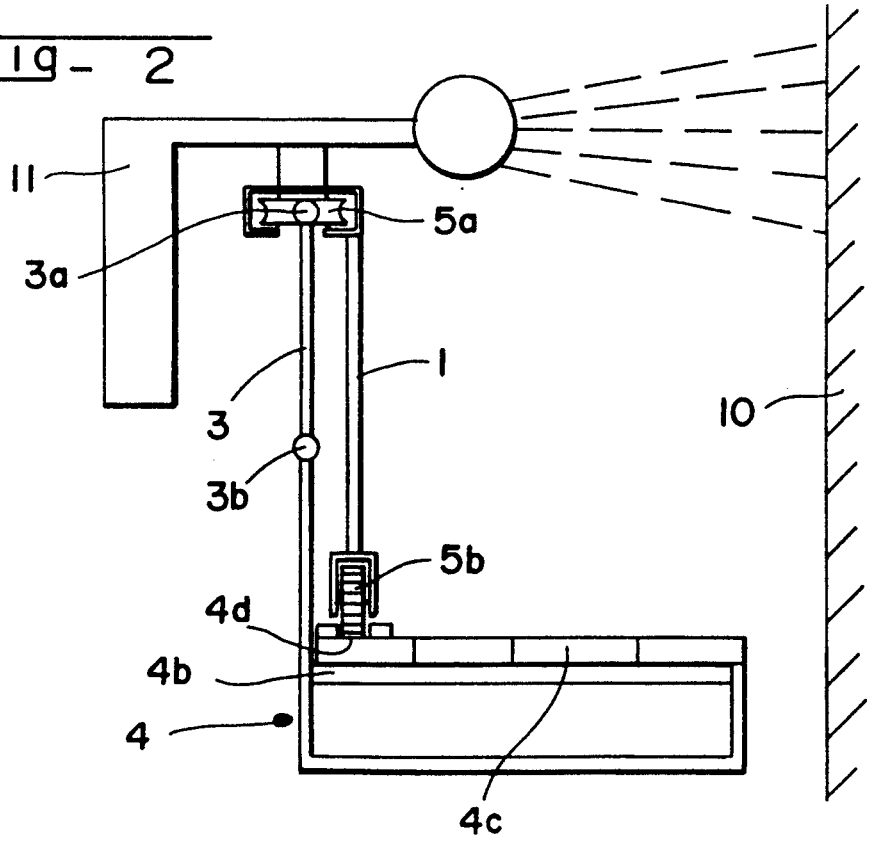
FIG. 2 is a cross-section through a further embodiment of the device of the invention whose truck rolls on the floor of the platform, while being principally guided and stabilized by the parapet of the latter; the load being transported is a spraying apparatus.

In the embodiment shown in FIG. 2, the base of the truck 1 is fitted with one or several wheels **5*b* bearing on the floor 4*c* of the platform 4 which may comprise a running and guide tread 4*d* disposed in the vicinity of and along the parapet 3**.

In the embodiment shown, the truck 1 also comprises in its upper portion a slide **5*a* mounted so as to slide on the upper head rail 3*a*** of the parapet.

In this embodiment, the truck 1 supports an apparatus 11 allowing a product to be sprayed onto the facade 10 of the building; the truck may however be provided with one or several apparatus or machines allowing different, completely or partly automated, works to be carried out on the building facades.

Figure 3:
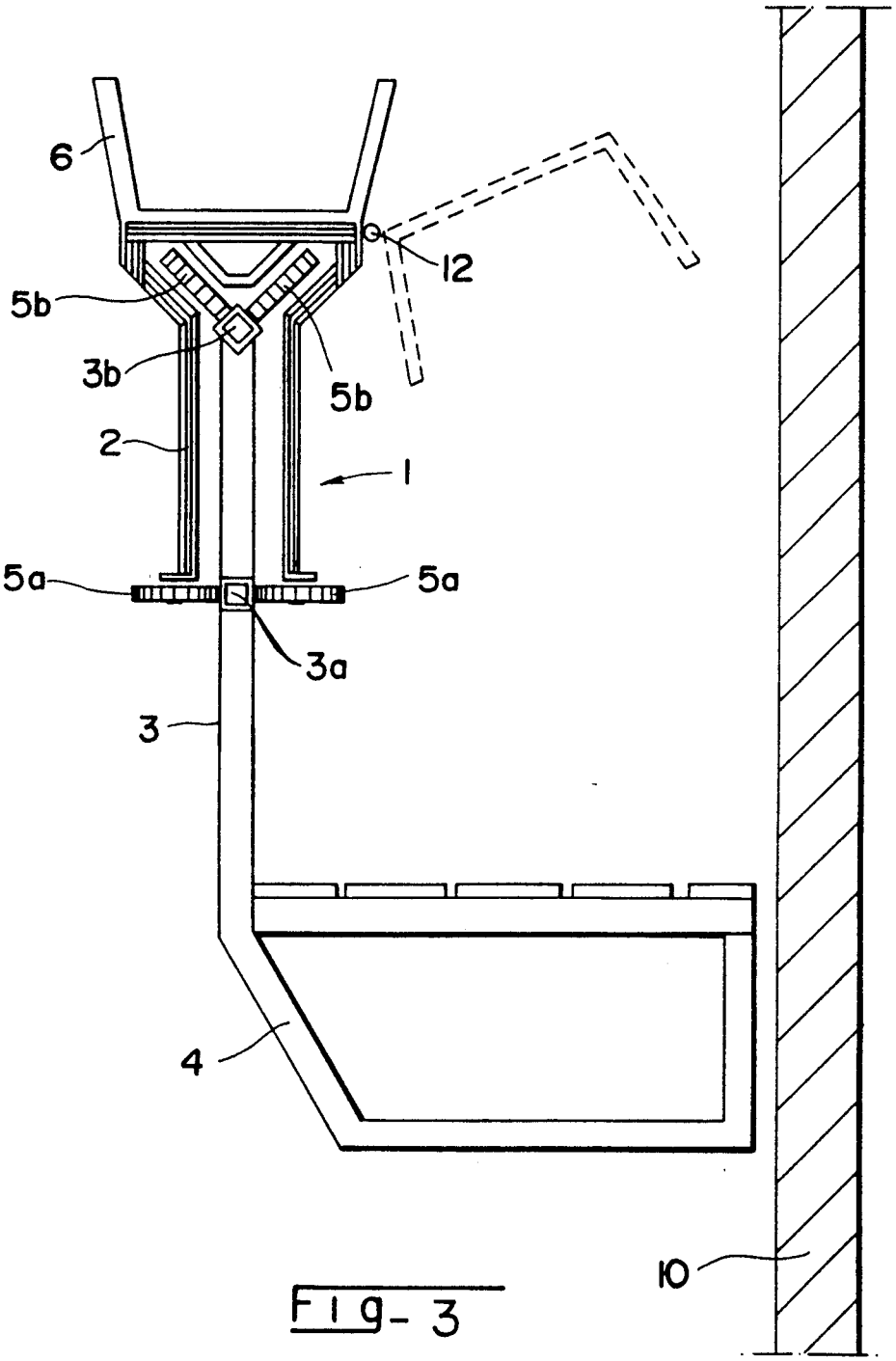
FIG. 3 is a cross-section through a third embodiment of the device of the invention whose truck rolls on the upper head rail of the parapet, while being principally guided and stabilized by the lower rail of the latter.

In the embodiment shown in FIG. 3, the truck 1 comprises a U-shaped framework or chassis 2 which is disposed so as to straddle the upper head rail **3*a* of the parapet 3 of the platform 4 installed in front of the facade 10** of the building.

In its upper portion, the chassis 2 is provided with several pairs of wheels or rollers **5*b* which are inclined at 45° so that they are tangential to the tube of square cross-section formed in this embodiment by the upper head rail 3*a* of the parapet 3. In this way the wheels 5*b* transmit the weight of the truck and its load to the parapet as well as part of the horizontal forces needed for stability. In its lower portion, the framework of the truck is provided with a slide formed by wheels or rollers 5*a* having a vertical axis which run on the opposite vertical surfaces of the tube of square cross-section forming the lower head rail 3*b*** of the parapet so as to transmit the remaining art of the horizontal forces of the device thereto.

In this embodiment, the truck 1 has a container 6 provided with a known tipping device 12 which allows the load transported by this container to be easily dumped.

Figure 4:
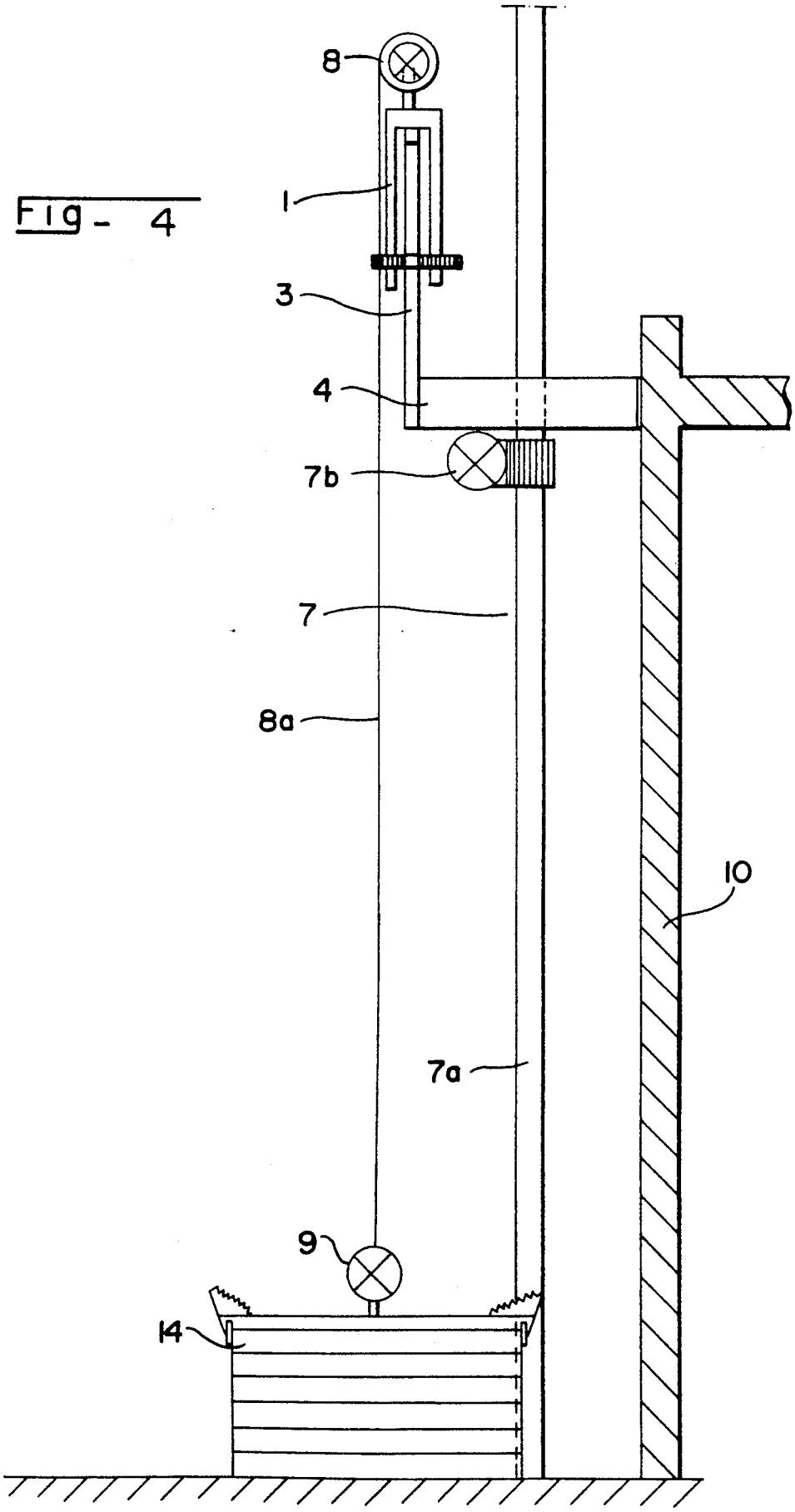
FIG. 4 is an elevation showing the platform equipped with the device of the invention, supported on a self-climbing scaffolding, which device is provided with a winch whose cable is provided with an automatic load gripper device.

In the embodiment shown in FIG. 4, the platform 4 is formed by the platform of a self-raising scaffolding 7 suspended from or supported by a lifting devices **7*b* on the poles 7*a*** erected and held in the lower portion of the building.

The truck 1 is of the type shown in FIG. 3 and straddles the parapet. It is provided with a motor driven winch 8 whose cable **8*a* is provided at its end with an automatic load gripper device 9, which loads take the form of plates 14** in the embodiment shown.

It can be seen that the movement of the truck 1 makes it possible; and take the loads from a storage location which is organized and distributed at the periphery of the building and deposit them at any point on the platform extending around the building.

I claim:

1. A device for transporting and distributing materials and/or equipment around the periphery of a building using a bearing structure including a parapet, comprising a truck including at least one first bearing element and at least one second bearing element, said at least one first bearing element and said at least one second bearing element being in double connection with an exterior portion of a framework of a parapet and capable of movement along the exterior of said framework of said parapet to permit said truck to be guided along the parapet, as well as to retain its stability when moving or at rest;

said at least one first bearing element including at least one first means for permitting sliding or rolling movement of said truck along at least one first rigid longitudinal element of the framework of said parapet, said at least one first bearing element being connected to said at least one first rigid longitudinal element enabling at least a horizontal component of force to be transmitted to the parapet;

said at least one second bearing element including at least one second means for permitting sliding or rolling movement of said truck on one of at least one of a second rigid longitudinal member of the framework of said parapet, a rigid longitudinal member on a platform of said parapet, or on a floor of a platform of said parapet, said second means for permitting sliding or rolling movement enabling at least the vertical component of force to be transmitted to at least one of the parapet, the bearing of reinforcement of the platform, and the floor of said platform.

2. The device according to claim 1, further including motorized means for driving said truck along the frame work of the parapet.

3. The device according to claim 1, wherein at least one of said at least one first bearing element and at least one second bearing element include means for vertical movement.

4. The device according to claim 3, further including motorized means for effecting the vertical movement.

5. The device according to claim 1, further including a means for tipping for depositing to dumping a load.

6. The device according to claim 5, further including a motorized means for effecting tipping movement of said means for tipping.

7. The device according to claim 1, further including means for lifting associated with said truck.

8. The device according to claim 7, wherein said means for lifting comprises a winch.

9. The device according to claim 7, wherein said means for lifting includes means for gripping loads.

10. The device according to claim 7, further including motorized means for effecting movement of said means for lifting.

11. The device according to claim 9, further including motorized means for effecting movement of said means for gripping loads, and for effecting movement of said means for lifting between a position and said truck.

12. The device according to claim 11, further including automated control means for controlling said motorized means.

13. The device according to claim 1, further including automated control means for controlling movement of said truck along the framework of the parapet.

14. The device according to claim 1, wherein said rigid longitudinal member on a platform of said parapet includes a guide tread.

15. A process for transporting and distributing materials and/or equipment around the periphery of a building using a bearing structure including a parapet, comprising:

moving a truck along an exterior portion of the framework of the parapet, said truck including at least one first bearing element and at least one second bearing element, the at least one first bearing element and the at least one second bearing element having a double connection with an exterior portion of the framework of the parapet, so as to permit the truck to be guided along the exterior portion of the parapet while maintaining its stability when moving or at rest;

the at least one first bearing element includes at least one first means for permitting sliding or rolling movement of the truck along at least one first rigid longitudinal element of the framework of the parapet, the at least one first bearing element being connected to the at least one first rigid longitudinal element enabling at least a horizontal component of force to be transmitted to the parapet;

the at least one second bearing element includes at least one second means for permitting sliding or rolling movement of the truck on one of at least one of a second rigid longitudinal member of the framework of said parapet, a rigid longitudinal member on a platform of said parapet, or on a floor of a platform of the parapet, the second means for permitting sliding or rolling movement enabling at least the vertical component of force to be transmitted to at least one of the parapet, the bearing of reinforcement of the platform, and the floor of the platform.

* * * * *